US008737652B2

(12) United States Patent
Kornagel

(10) Patent No.: US 8,737,652 B2
(45) Date of Patent: May 27, 2014

(54) METHOD FOR OPERATING A HEARING DEVICE AND HEARING DEVICE WITH SELECTIVELY ADJUSTED SIGNAL WEIGHING VALUES

(75) Inventor: Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 936 days.

(21) Appl. No.: 12/436,880

(22) Filed: May 7, 2009

(65) Prior Publication Data

US 2009/0285422 A1 Nov. 19, 2009

(30) Foreign Application Priority Data

May 13, 2008 (DE) ..... 10 2008 023 370

(51) Int. Cl.
*H04R 25/00* (2006.01)

(52) U.S. Cl.
USPC ..... 381/317; 381/313

(58) Field of Classification Search
USPC ..... 381/313, 317
See application file for complete search history.

(56) References Cited

U.S. PATENT DOCUMENTS

2006/0053002 A1* 3/2006 Visser et al. ..... 704/200
2007/0269053 A1* 11/2007 Meier et al. ..... 381/74

FOREIGN PATENT DOCUMENTS

| | | | |
|---|---|---|---|
| DE | 19948907 | A1 | 2/2001 |
| DE | 10245567 | B3 | 4/2004 |
| DE | 102006047982 | A1 | 4/2008 |
| EP | 1489882 | A2 | 12/2004 |
| EP | 1912472 | A1 | 4/2008 |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A method for operating a hearing device and a hearing device are provided. Electrical acoustic signals are generated by the hearing device from a recorded ambient sound, the electrical signals being weighted according to their degree of matching with a predefinable acoustic signal class and being mixed together to form an output sound signal. The weight of the acoustic signal is greater or lesser, the greater the extent of the degree of matching.

15 Claims, 2 Drawing Sheets

METHOD FOR OPERATING A HEARING DEVICE AND HEARING DEVICE WITH SELECTIVELY ADJUSTED SIGNAL WEIGHING VALUES

CROSS REFERENCE TO RELATED APPLICATIONS

This application claims priority of German Patent Application No. 10 2008 023 370.6 DE filed May 13, 2008, which is incorporated by reference herein in its entirety.

FIELD OF INVENTION

The invention relates to a method for operating a hearing device and a hearing device.

BACKGROUND OF INVENTION

Interference noises or unwanted acoustic signals are omnipresent during a conversation between persons. These interfere with the human voice of a person or with a desired acoustic signal. Hearing device wearers are particularly prone to interference noises and unwanted acoustic signals. Conversations in the background, acoustic disturbances from electronic devices, like for instance mobile telephones, as well as noises in the surroundings can make it difficult for a person wearing a hearing device to understand a desired speaker. A reduction in the interference noise level in an acoustic signal, coupled with an automatic focus on a desired acoustic signal component can significantly improve the performance of a digital speech processor, as is used in modern hearing aids.

Hearing devices with a digital signal processing contain one or more microphones, A/D converters, digital signal processors and loudspeakers. Digital signal processors generally divide the incoming signals into a plurality of frequency bands. A signal amplification and processing can be individually adjusted within each band so as to match the requirements of a specific wearer of the hearing device. Furthermore, algorithms for feedback and interference noise minimization are also available in the case of digital signal processing, said algorithms nevertheless also being disadvantageous. The disadvantage with the currently existing algorithms for interference noise minimization is for instance the restricted improvement thereof in terms of the hearing device acoustics, if speech and background noises are in the same frequency range and they are thus not able to distinguish between spoken speech and background noise. This is one of the most frequent aims in the field of acoustic signal processing, namely to filter out one or a plurality of signals from different, superimposing acoustic signals. This is also referred to as the so-called "cocktail party problem". Here different noises, such as music and chatter, mix to form an indefinable background noise. Nevertheless, it is generally not difficult for a person without a hearing impairment to converse with another person in such a situation. It is thus desirable for hearing device wearers to be able to chat in such situations in a similar way to people without a hearing impairment.

Spatial, e.g. directional microphone or beam forming, statistical, e.g. Blind Source Separation (BSS: "Separation of non visible sound sources") or mixed methods exist in the acoustic signal processing, which can inter alia separate a single sound source or a plurality thereof from a number of simultaneously active sound sources using algorithms. BSS thus enables a separation of source signals without previous knowledge of their geometric arrangement by means of statistical signal processing of at least two microphone signals. When used in hearing devices, this method is advantageous compared with conventional directional microphone solutions. As a matter of principle, up to n sources can be separated, i.e. n output signals can be generated, using a BSS method with n microphones.

Numerous methods for BSS are known from the literature, with acoustic sources being analyzed by analyzing at least two microphone signals. The subsequently published patent application DE 10 2006 047 982 provides a good overview.

The control of directional microphones within the sense of BSS is subject to ambiguities as soon as several concurrent useful sources, e.g. speakers, are present at the same time. BSS in principle allows the separation of different sources, provided these are spatially separated. The ambiguity nevertheless reduces the potential use of a directional microphone, although a directional microphone can be particularly useful in such scenarios in order to improve speech intelligibility.

The hearing device and/or the mathematical algorithms for BSS have in principle the problem of having to decide which of the signals generated by BSS are to be most advantageously forwarded to the hearing aid wearer. In principle this is an insoluble problem for the hearing aid since the selection of wanted acoustic sources depends directly on the momentary wishes of the hearing aid wearer and a selection algorithm can thus not be present as an input variable. The selection affected by this algorithm must therefore draw upon the assumptions relating to the probable wishes of the hearer.

In the prior art, the hearing aid wearer preferably assumes an acoustic signal from a 0° direction, in other words the line of vision of the hearing aid wearer. This is realistic since the hearing aid wearer would look at his/her current conversational partner in an acoustically difficult situation in order to gain further information in terms of increasing the speech intelligibility of the conversational partner (e.g. lip movements). The hearing aid wearer is however herewith obliged to see his/her conversational partner so that the directional microphone results in increased speech intelligibility. This is particularly inconvenient if the hearing aid wearer wishes to converse with precisely one individual person, i.e. is not included in a communication with several speakers and would not like/have to always see his/her conversational partner.

SUMMARY OF INVENTION

An object of the invention is to specify an improved method for operating a hearing device, as well as an improved hearing device, with which it is possible to distinguish which output signals of a source separation, in particular a BSS, are acoustically supplied to the hearing aid wearer.

According to the invention, the set object is achieved with a method and a hearing device as claimed in the claims.

The invention includes a method for operating a hearing device, with electrical acoustic signals being generated by the hearing device from a recorded ambient sound. These are weighted according to the degree to which they match a predefinable acoustic signal class and are mixed together to form an output acoustic signal. The weight of the acoustic signal is greater or lesser depending on the degree of matching. This is advantageous in that a desired signal can be provided to a hearing device user from a plurality of ambient acoustic signals.

In one development, the degree of matching can be determined by the features volume, frequency range, fundamental frequency, cepstral coefficients and/or temporal course of the acoustic signals. A high flexibility is achieved as a result.

In a further embodiment, the predefinable acoustic signal class can include the classes speech and/or human voice, in a predefinable wave band, male voice, female voice, child's voice, voice of a predefinable person, music and ambient noise. This provides the advantage of a large selection for a hearing device user.

The predefinable acoustic signal class can also include any combination of classes.

Furthermore, the electrical acoustic signals can be generated from the ambient sound by means of a Blind Source Separation method. This results in a good acoustic signal separation.

The degree of matching can be advantageously determined by a feature analysis of the electrical acoustic signals, with a probability of the match with a predefinable acoustic signal class being determined for the electrical acoustic signals. The simple computational weighting is advantageous in this case.

A hearing device with at least one microphone for recording an ambient sound and with a segregation unit for generating electrical acoustic signals from the recorded ambient sound is also specified. The hearing device includes a signal processing unit, by means of which acoustic signals can be weighted according to their degree of matching with a predeterminable acoustic signal class and can be mixed to form an output acoustic signal, with the weight of the acoustic signal being greater or lesser depending on the degree of matching. As a result, the switchover between acoustic signal classes can take place "smoothly".

In one development, the segregation unit can include a blind source separation module.

In a further embodiment, the signal processing unit can include at least one classification module, at least one weight determination module, at least one multiplier and at least one adder.

Furthermore, the hearing device can include an acoustic signal class input unit, with which the desired, predefinable acoustic signal class is communicated to the hearing device. This can be arranged on the hearing device or in a remote controller.

BRIEF DESCRIPTION OF THE DRAWINGS

Further details and advantages of the invention are apparent from the subsequent explanations of several exemplary embodiments with reference to schematic drawings, in which.

DETAILED DESCRIPTION OF INVENTION

Figure 1:
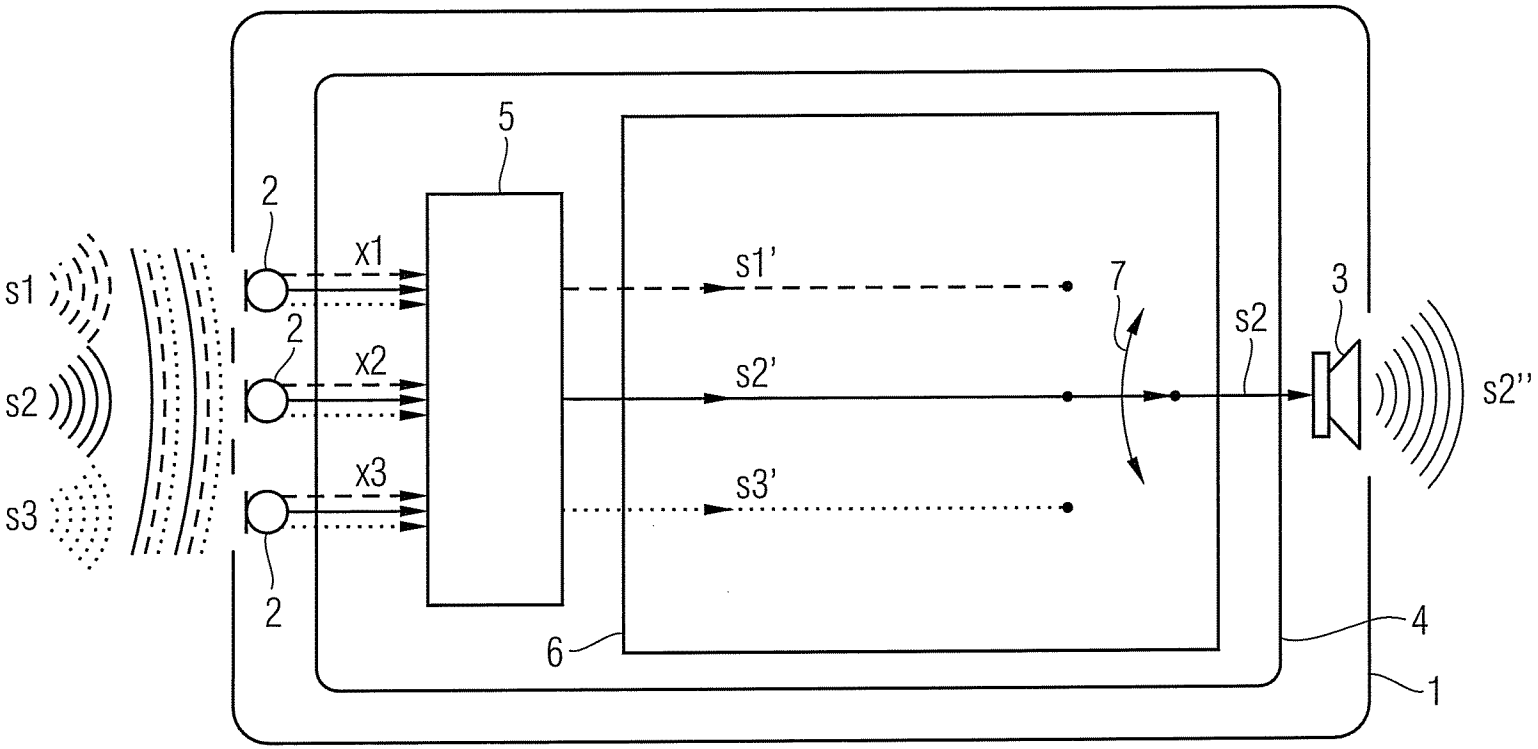
FIG. 1: shows a block diagram of a hearing device with blind source separation according to the prior art

FIG. 1 shows the prior art of a hearing device 1 comprising three microphones 2 and a segregation unit 5 according to the blind source separation method. Three signal sources generate three acoustic ambient acoustic signals s1, s2, s3, which are received by the three microphones 2 and are converted into electrical microphone signals X1, X2, X3. The three microphone signals x1, x2, x3 are each fed to a signal input in the segregation unit 5. The blind source separation method proceeds in the segregation unit 5, with the aid of which the ambient acoustic signals s1, s2, s3 can be reconstructed from the mixed electrical microphone signals x1, x2, x3. Three electrical acoustic signals s1', s2', s3' are thus available at three outputs of the segregation unit 5.

In the simplest case, a hearing device user can make a selection between the three separately reproduced acoustic signals s1', s2', s3' with the aid of a selection switch 7 in a post processor module 6. In FIG. 1, the electrical acoustic signal s2' was selected and forwarded to a receiver 3. The segregation unit 5 and the post processor module form a signal processing unit 4.

The receiver 3 sends the signal s2", which corresponds approximately to the acoustic ambient acoustic signal s2, as an acoustic output signal. With the aid of the hearing device 1 in FIG. 1, different acoustic input signals can thus be separated and can be separately output via the receiver 3 in accordance with the preferences of a hearing device user.

A hearing device wearer does not always want a stringent switchover between different input signal sources of this type. It is also not always possible for a segregation unit 5 to prepare the signals in a clean and reliably separated fashion. An improved representation of different ambient sound signals is thus offered by the apparatus in FIG. 2.

Figure 2:
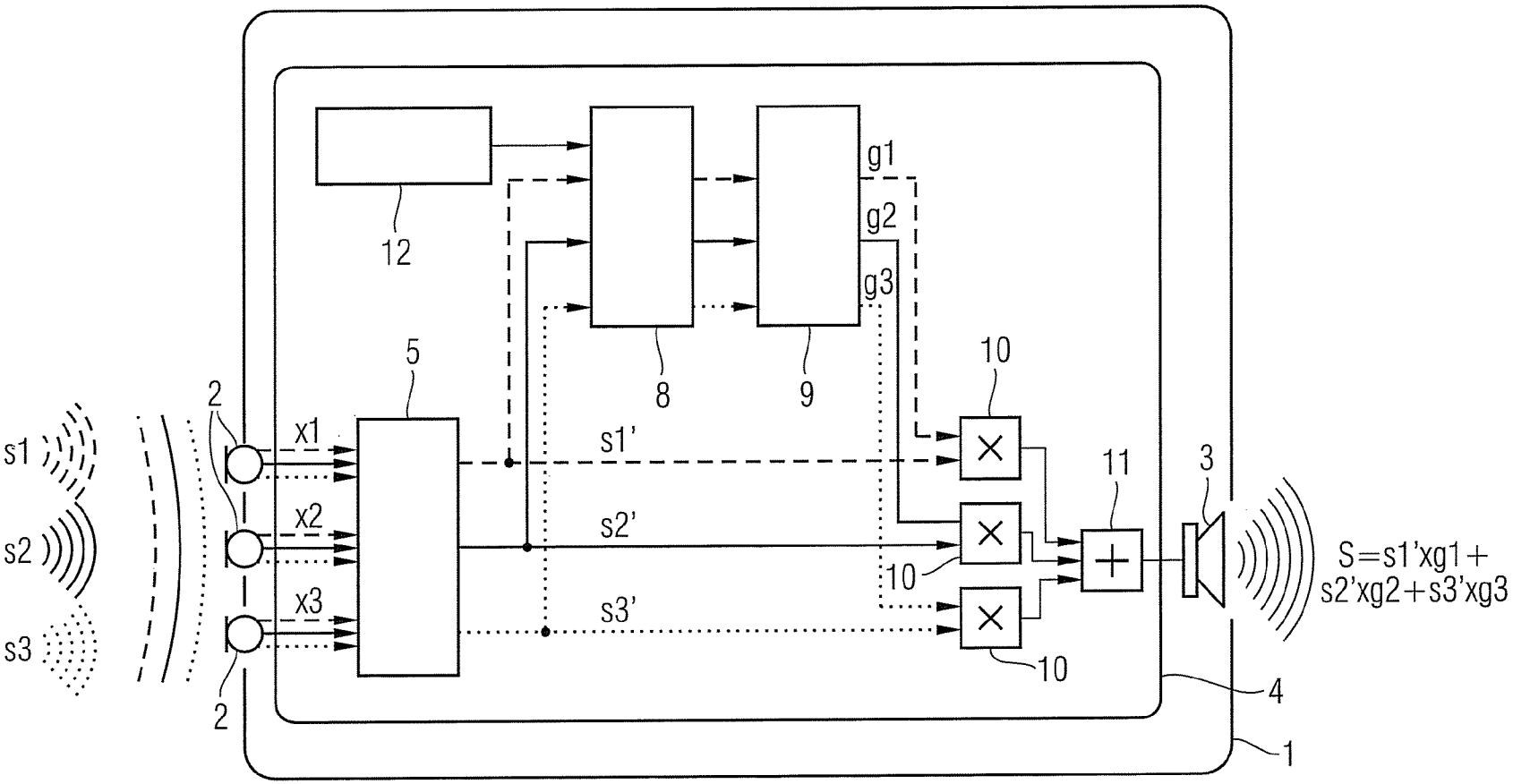
FIG. 2: shows a block diagram of a hearing device.

FIG. 2 shows a hearing device 1 comprising three microphones 2, a signal processing unit 4 and a receiver and/or loudspeaker 3. Three ambient sound signals s1, s2, s3 are recorded by the microphones 2 and routed to the signal processing unit 4 as microphone signals x1, x2, x3. The microphone signals x1, x2, x3 prepared by the signal processing unit 4 are then routed to an input of the receiver 3 and provided to the hearing device user as one acoustic output signal s.

In the signal processing unit 4, the microphone signals x1, x2, x3 are processed with the aid of a segregation unit 5 and are routed to the further processing units as segregated electrical acoustic signals s1', s2', s3'. The electrical acoustic signals s1', s2', s3' reach the inputs of multipliers 10 on the one hand, and the inputs of a classification module 8 on the other hand. An acoustic signal class input unit 12 allows a hearing device user to predefine a preferred acoustic signal class. This specification is routed to the classification module 8 and processed therein. The preselected acoustic signal class may include for instance a male voice, a female voice, a child's voice or also a certain frequency range, or in general human voices and/or speech, or music etc. In the classification module 8, the probability can be calculated for instance, with which an electrical acoustic signal s1', s2', s3', belongs to a certain acoustic signal class. This degree of matching is now weighted accordingly with the aid of a weight determination module 9. To this end, the degrees of matching of the classified signals are routed from outputs of the classification module 8 to inputs of the weight determination module 9. The weight determination module 9 now determines the weights g1, g2, g3 for instance such that the weight of an acoustic signal is selected to be greater, the higher the degree of matching with the preselected class. The weights g1, g2, g3 are routed to these corresponding inputs of the multiplier 10. The electrical acoustic signals s1', s2', s3' are now multiplied in the multipliers 10 with the weights g1, g2, g3. The weighted electrical acoustic signals are routed to an adder 11 from outputs of the multiplier 10. These signals are added in the adder 11 and made available to the output of the adder 11. The electrical signal is then converted at the output of the adder in the receiver 3 into an output acoustic signal S.

The invention claimed is:

1. A method of operating a hearing device with selectively adjusted signal weighing values, comprising:

generating electric acoustic signals by the hearing device from a recorded ambient sound;

selecting an acoustic signal class from a plurality of user-selectable acoustic signal classes;

determining a respective degree of matching of the electric acoustic signals relative to the selected acoustic signal class;

weighting the electric acoustic signals according to a respective degree of matching of the electric acoustic signals relative to the selected acoustic signal class; and mixing in an adder the weighted electric acoustic signals together to supply in an output port of the adder one additively mixed output signal, which forms an output sound signal, wherein respective weights of the electric acoustic signals are selectively adjusted so that a relatively higher weighing value is assigned to a respective electric acoustic signal having a relatively higher degree of matching relatively to the selected acoustic signal class and a relatively lower weighing value is assigned to a respective electric acoustic signal having a relatively lower degree of matching relatively to the selected acoustic signal class.

2. The method as claimed in claim 1, wherein the degree of matching is determined by a signal feature selected from the group consisting of volume, frequency range, fundamental frequency, cepstral coefficients, temporal curve of the electric acoustic signals and a combination thereof.

3. The method as claimed in claim 1, wherein the plurality of user-selectable acoustic signal classes comprise the following classes:

speech and/or human voice, in a predefinable wave band, male voice, female voice, child's voice, voice of a predefinable person, music, and ambient noise.

4. The method as claimed in claim 2, wherein the plurality of user-selectable acoustic signal classes comprise the following classes:

speech and/or human voice, in a predefinable wave band, male voice, female voice, child's voice, voice of a predefinable person, music, and ambient noise.

5. The method as claimed in claim 3, wherein the plurality of user-selectable acoustic signal classes include any combination of the classes.

6. The method as claimed in claim 4, wherein the plurality of user-selectable acoustic signal classes include any combination of the classes.

7. The method as claimed in claim 1, wherein the electric acoustic signals are generated from the ambient sound by a blind source separation method.

8. The method as claimed in claim 1, further comprising:

determining the degree of matching by a signal feature analysis of the electric acoustic signals, wherein a probability of the degree of matching with a predefinable acoustic signal class is determined for the electric acoustic signals.

9. A non-transitory computer readable medium storing a computer program, which, when executed in a control unit, performs a method, comprising:

generating electric acoustic signals by a hearing device from a recorded ambient sound;

selecting an acoustic signal class from a plurality of user-selectable acoustic signal classes;

determining a respective degree of matching of the electric acoustic signals relative to the selected acoustic signal class;

weighting the electric acoustic signals according to a respective degree of matching of the electric signals relative to the selected acoustic signal class; and mixing in an adder the weighed electric acoustic signals together to supply in an output port of the adder one additively mixed output signal, which forms an output sound signal, wherein respective weights of the electric acoustic signals are selectively adjusted so that a relatively higher weighing value is assigned to a respective electric acoustic signal having a relatively higher degree of match relatively to the selected acoustic signal class and a relatively lower weighing value is assigned to a respective electric acoustic signal having a relatively lower degree of match relatively to the selected acoustic signal class.

10. The computer readable medium as claimed in claim 9, wherein the degree of matching is determined by a signal feature selected from the group consisting of volume, frequency range, fundamental frequency, cepstral coefficients, temporal curve of the acoustic signals and a combination thereof.

11. The computer readable medium as claimed in claim 9, wherein the plurality of user-selectable acoustic signal classes comprise the following classes:

speech and/or human voice, in a predefinable wave band, male voice, female voice, child's voice, voice of a predefinable person, music, and ambient noise.

12. The computer readable medium as claimed in claim 9, wherein the electric acoustic signals are generated from the ambient sound by a blind source separation method.

13. The computer readable medium as claimed in claim 9, further comprising:

determining the degree of matching by a signal feature analysis of the electric acoustic signals, wherein a probability of the degree of matching with a predefinable acoustic signal class is determined for the electric acoustic signals.

14. A hearing device with selectively adjusted signal weighing values, comprising:

a microphone for recording an ambient sound;

a segregation unit for generating electric acoustic signals from the recorded ambient sound;

an acoustic signal class input unit configured to select an acoustic signal class from a plurality of user-selectable acoustic signal classes;

a classification module coupled to the acoustic signal class input unit and configured to determine a respective degree of matching of the electric acoustic signals relative to the selected acoustic signal class;

a signal processing unit configured to weight the electric acoustic signals according to a respective degree of matching of the electric acoustic signals relative to the selected acoustic signal class, wherein respective weights of the electric acoustic signals are selectively adjusted so that a relatively higher weighing value is assigned to a respective electric acoustic signal having a relatively higher degree of match relatively to the selected acoustic signal class and a relatively lower weighing value is assigned to a respective electric acoustic signal having a relatively lower degree of match relatively to the selected acoustic signal class; and an adder coupled to receive the weighted electric acoustic signals from the signal processing unit to supply thru an output port of the adder an additively mixed output signal, which forms an output sound signal.

15. The hearing device as claimed in claim 14, wherein the segregation unit includes a blind source separation module.

* * * * *